US005785204A

United States Patent [19]

Thompson et al.

[11] Patent Number: 5,785,204

[45] Date of Patent: Jul. 28, 1998

[54] VENDING MACHINE INSTALLATION AND PAVILION WITH INTERACTIVE CUSTOMER COOLING ACCESSORY

[75] Inventors: George L. Thompson, Snellville; Kathleen Fitzsimmons Socha, Smyrna; Lee Jones, Atlanta, all of Ga.

[73] Assignee: The Coca-Cola Company, Atlanta, Ga.

[21] Appl. No.: 652,924

[22] Filed: May 24, 1996

[51] Int. Cl.[6] ..... A24F 15/04

[52] U.S. Cl. ..... 221/24; 62/314

[58] Field of Search ..... 221/24, 150 R, 221/135; 62/314

[56] References Cited

U.S. PATENT DOCUMENTS 4,324,059 4/1982 Baum ..... 221/24

5,497,633 3/1996 Jones et al. ..... 62/314

*Primary Examiner*—Kenneth Noland

[57] ABSTRACT

A vending machine installation includes a misting accessory which discharges an evaporative cooling mist and is provided for interactive operation by a customer purchasing a product. The misting accessory is disposed above the vending machine or machines and includes a mist nozzle assembly within a simulated beverage bottle surrounded by a simulated bed of ice. Also provided is a sound generator for simulating the sound of gas escaping from the opening of the container of the beverage in response to vend signals generated by the customer operating the machine. The sound generator and the mister are initiated simultaneously. The simulated beverage bottle may be provided with a hinged bottle cap which flips open during operation of the mister. A pavilion incorporating vending machines and an array of misting nozzle assemblies provides evaporative cooling to persons within the pavilion. The vending machine installation and the pavilion employ nozzle assemblies which discharge an evaporative cooling mist formed by combining a water/air mist and an air delivery current.

19 Claims, 3 Drawing Sheets

VENDING MACHINE INSTALLATION AND PAVILION WITH INTERACTIVE CUSTOMER COOLING ACCESSORY

BACKGROUND OF THE INVENTION

The present invention relates to a vending machine installation including a misting accessory which attracts customers and enhances awareness of the identity of the product being vended. The present invention also relates to a pavilion incorporating vending machines and an array of misting nozzle assemblies providing evaporative cooling to persons within the pavilion. More specifically, the present invention relates to a vending machine installation and a pavilion incorporating an accessory which interacts with customers visually, audibly and physically in order to convey the cooling and refreshing attributes of the product being vended to the customer.

Various auxiliary devices have previously been integrated into vending machines in order to attract customers' attention and to increase sales of the products to be vended. These devices include talking devices which audibly communicate various messages, greetings and advertisements to customers, musical devices which output uplifting jingles and advertisements to customers, coupon dispensers which dispense discount coupons for future purchases of the products, and game devices such as video games which the customer can play in conjunction with the purchase of products being vended.

All of the above devices, integrated into vending machines, are utilized to attract customers to the vending machines and increase product awareness.

Recently, in order to further increase product awareness improved sign panels and associated graphics have been developed to visually illustrate attributes of products including the ability to cool and refresh the consumer. Various types of graphics include beds of ice, frosting or the like for conveying to the customer the refreshing and cooling characteristics of the product. The cooling and refreshing nature of the product are particularly important in environments where temperatures may be high, as in amusement parks visited during warm weather months.

It is generally known in amusement parks to provide enclosures which customers of the park may walk into and be sprayed with water, or a water mist, to cool them off on hot summer days. These cooling areas are popular and give temporary relief from the heat.

U.S. Pat. No. 5,497,633, issued to Michael Jones and Mark Hensley, discloses apparatuses in which evaporative cooling is provided by adding a water mist from a nozzle or nozzles to an air current produced by a blower and discharging the cloud-like mixture to the local atmosphere.

Known apparatuses for providing evaporative cooling, such as those disclosed in the Jones et al. patent, generally require high pressure water supplies in order to achieve satisfactory atomization within the mist nozzles. The equipment for supplying the high pressure water can be bulky and expensive. Also, these evaporative cooling apparatuses are generally used for sustained periods and are not particularly well suited for intermittent operation.

Known misting or cooling enclosures in amusement parks or other sites where people gather are not directly or interactively associated with the sale of beverages. Rather, they are provided as separate attractions to cool off customers of the amusement park, to make their stay more enjoyable on a hot summer day.

For conveying the cooling and refreshing attributes of vending products to customers of the vended products, it would be advantageous to be able to communicate with the customer beyond the normal visual communication provided by improved sign panels and graphics relating to the cooling and refreshing attributes of the products. It would additionally be advantageous to be able to audibly and physically communicate with the customer the refreshing attributes of the products to be vended in an interactive way associated with the vending of the products and the operation of the vending machines by the customer.

OBJECTS AND SUMMARY OF THE INVENTION

Accordingly, it is a primary object of the present invention to provide a vending machine installation including means for attracting customers to increase sales of the products and to enhance the awareness of product identity being dispensed from the machines.

It is another object of the present invention to provide an accessory coupled to a vending machine which interacts with the customer visually, audibly and physically in order to convey the cooling and refreshing attributes of the vendable products to the customer.

It is another object of the present invention to provide an accessory coupled to a vending machine which interactively involves the customer in the purchase of the product in a positive way related to the attributes of the product.

It is another object of the present invention to provide an assembly integrated into a vending machine which enhances the customer's perception of the cooling and refreshing attributes of the vendable products.

It is another object of the present invention to provide a vending machine accessory which discharges an evaporative cooling mist toward a customer as a consequence of the purchase of an item from the machine.

It is another object of the present invention to provide an accessory which discharges a cooling mist, is of compact construction, requires relatively low water pressure and is well adapted for intermittent operation.

It is another object of the present invention to provide a pavilion incorporating an evaporative cooling arrangement which requires relatively low water pressure and is well adapted for intermittent operation.

The foregoing objects of the present invention and others as well are fulfilled by providing a vending machine installation comprising: at least one vending machine incorporating vend control means for receiving input signals from a customer requesting the dispensing of a selected item and producing vend signals in response thereto; and a misting accessory disposed above the at least one vending machine for delivering a cooling mist to the customer in response to the vend signals.

The objects of the present invention are also fulfilled by providing a pavilion accommodating a gathering of persons and providing evaporative cooling for persons so accommodated, the pavilion comprising: at least one vending machine disposed within the pavilion, the at least one vending machine incorporating vend control means for receiving input signals from a customer requesting the dispensing of a selected item and producing vend signals in response thereto; an array of elevated nozzle assemblies for discharging a cooling mist; and control means responsive to the vend signals for operating at least one nozzle assembly to discharge a cooling mist.

The objects of the present invention are also fulfilled by providing a pavilion accommodating a gathering of persons and providing evaporative cooling for persons so accommodated, the pavilion comprising: an array of elevated nozzle assemblies for discharging a cooling mist, each of the nozzle assemblies incorporating a mist nozzle for discharging a water/air mist and an air nozzle for discharging an air delivery current which entrains the water/air mist discharging from the mist nozzle.

The present invention further includes a sound generator in the vending machine for simulating the sound of $CO_2$ gas escaping upon opening of a container of the beverage in response to the vend signal.

Also in a preferred embodiment, a portion of a simulated beverage bottle including the bottle neck is disposed on the top of the vending machine and is surrounded by a simulated bed of ice in order to further visually convey the cooling characteristics of the beverages within the vending machine.

Still further the simulated beverage bottle portion on the top of the vending machine may be provided with a hinged bottle cap which can pivot to an open position simultaneously with the discharge of the mist and the generation of the sound of escaping $CO_2$ gas to audibly and visually enhance the message that the products to be vended from the machine will refresh the customer.

Preferably the vending machine installation includes at least two independently operable vending units disposed side-by-side. Both of these units are coupled to the misting accessory of the present invention. Thus, customers at either of the vending units may be treated to the cooling mist.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention and wherein.

DETAILED DESCRIPTION OF PREFERRED EMBODIMENTS

Figure 1:
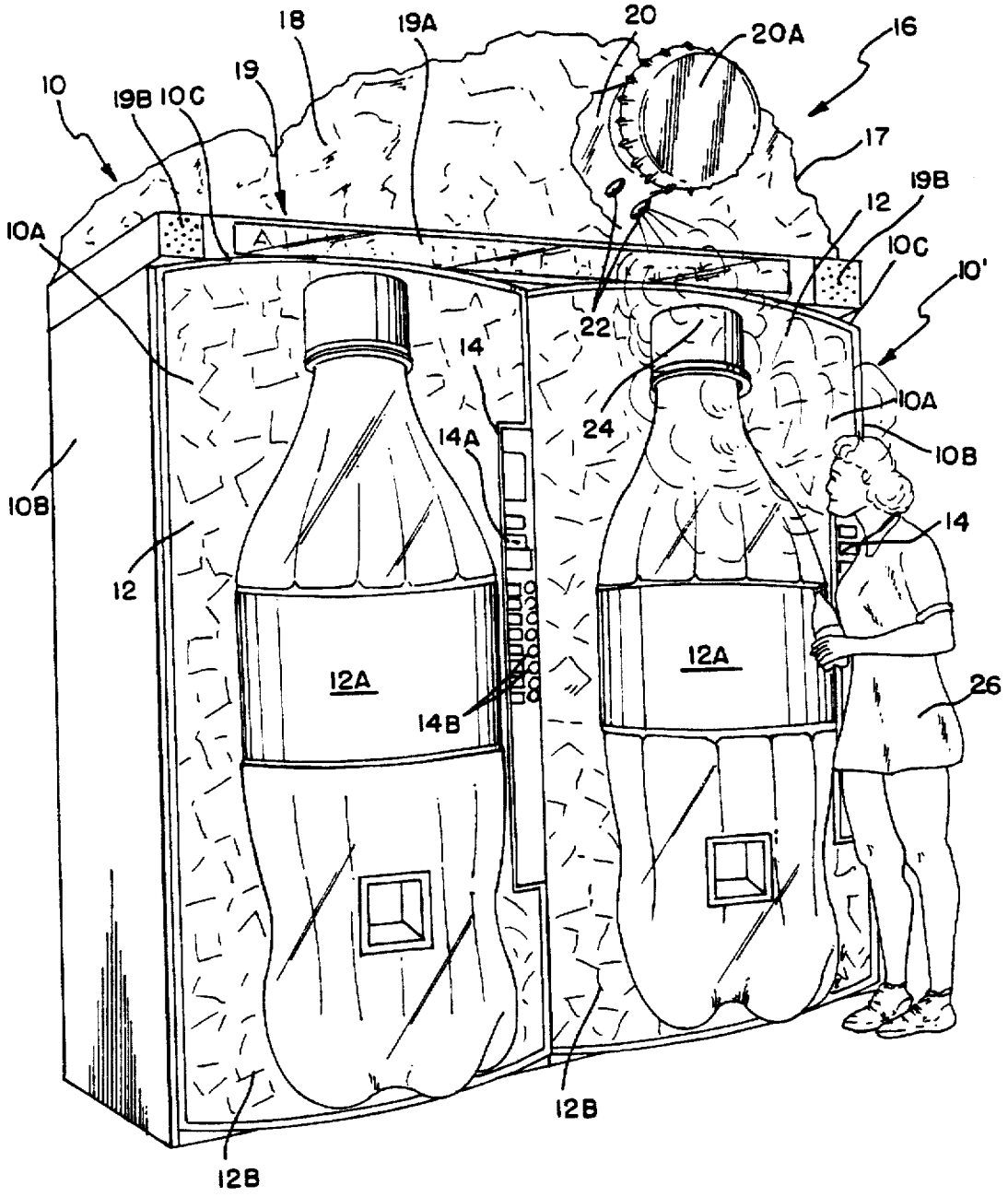
FIG. 1 is a perspective view showing a vending machine installation in accordance with the present invention comprising two side-by-side vending machines.

Referring to FIG. 1, there is illustrated a vending machine installation in accordance with the present invention which includes two independently operated side-by-side vending machines 10 and 10'. Each unit has front and side panels 10A, 10B which may carry advertising graphics. As illustrated, the front panel of each vending machine carries a relieved representation of a bottle 12A corresponding to at least one of the products therein to be vended. The graphics surrounding the illustrated bottles depict a bed of ice chunks 12B. The bottles shown on the front panels of the vending machines are the Coca-Cola "Contour" bottle which is a registered trademark of The Coca-Cola Company. The front panels of each vending machine also carry an independently operable control panel 14 including a coin or paper currency slot 14A and product selection buttons 14B.

A misting accessory 16 is supported above the two side-by-side vending machines by structure (not shown) which permits removal of either vending machine for convenient servicing. As illustrated, the misting accessory includes a housing 17 in the shape of an ice bed 18 from which extends a bottle neck 20. A cap 20A is mounted to the bottle neck for pivoting movement to a position which simulates the opening of the bottle. Angularly spaced ports 22 in the bottle neck accommodate nozzle assemblies (to be described) from which a cooling mist 24 discharges in the direction of a vending machine customer 26. A panel 19 incorporating a display 19A and speakers 19B at each end extends along the front of the housing 17. Located within and concealed by the housing are the components for generating a cooling mist, sounds and visual messages and for moving the bottle cap, as will be described.

Figure 2:
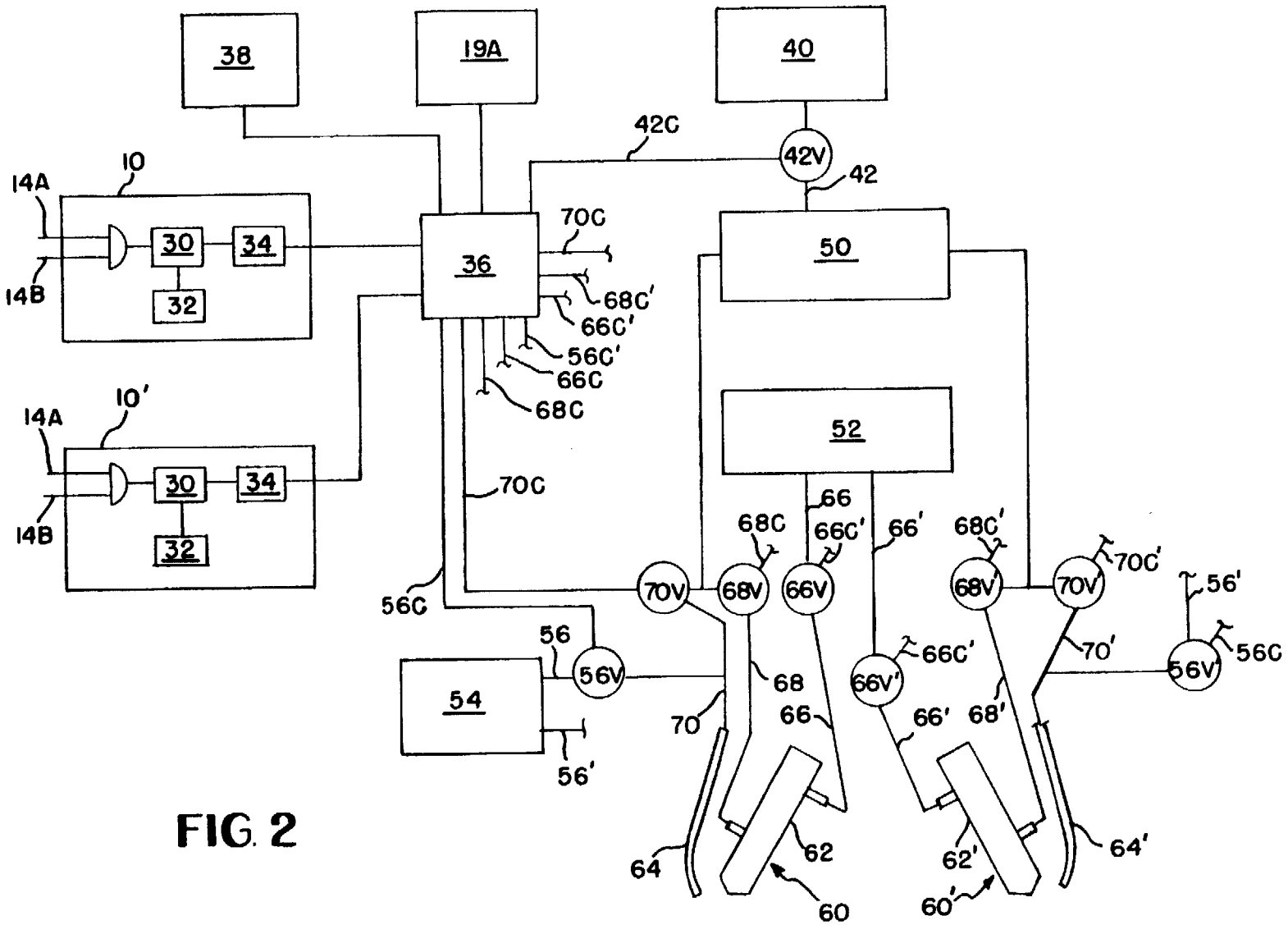
FIG. 2 is a schematic illustration of the operating components of the misting accessory employed in the vending machine installation of FIG. 1.

As illustrated schematically in FIG. 2, vending machines 10 and 10' each include a vend control unit 30 for receiving currency input signals at 14A in conjunction with product selection signals at input 14B through an AND gate or the like. Receipt of these signals causes the vending of a selected product by providing a signal to vend motors 32 in a known manner. The vend control unit 30 also provides signals to an interface device control unit 34. A readily available programmable logic controller 36 receives signals from the vending machines via the interface device control units 34. Controller 36 provides signals which operate sound generator 38, display 19A, motor 40 for pivoted bottle cap 20A and mist nozzle assemblies 60, 60'.

An array of LEDs may serve as the display 19A, and a micro-chip, CD player or tape player may serve as the sound generator 38, which is connected to the speakers 19B on panel 19. As illustrated, the bottle cap 20A is operated by an air motor 40 coupled by conduit 42 to pressurized air supply 50. An air motor valve 42V in conduit 42 is coupled to controller 36 via line 42C and operates in response to signals from the controller to control the application of pressurized air to motor 40.

Each mist nozzle assembly includes a mist nozzle 62, 62' and an adjacent air nozzle 64, 64'. Water at a suitable pressure of, say, 30 psi is conveyed from water supply 52 to the mist nozzles via conduits 66, 66'. Air at a suitable pressure of, say, 30 psi is conveyed from air supply 50 to the mist nozzles via conduits 68, 68' and to the air nozzles via conduits 70, 70'. The mist nozzles may be chosen from readily available nozzles which mix relatively low pressure water and air and produce a water/air mist cloud containing very fine water droplets. The air nozzles may be formed by small diameter tubing and are oriented so that they discharge an air current which intersects with the mist issuing from the discharge outlet of the adjacent mist nozzle. The mist and air nozzles may alternatively be incorporated in a unitary nozzle body.

If deemed advantageous, the cooling mist may carry an aroma which is evocative of a beverage flavor, or some other pleasing flavor or scent. The aroma can be provided by an aromatic agent supplied as an aerosol from pressurized source 54 connected by conduits 56, 56' with air conduits 70, 70'. The flow of the aromatic agent into the air conduits is controlled by valves 56V, 56V' which operate in response to signals received from controller 36 via lines 56C, 56C'.

Valves 66V, 66V', 68V, 68V', 70V, 70V' in the water and air conduits are coupled to controller 36 via lines 66C, 66C', 68C, 68C', 70C, 70C' and operate in response to signals from the controller to control the flow of water and air to the mist nozzle assemblies.

In a typical operating scheme, when a sale is not taking place at one of the vending machines, advertising or promotional messages will be presented on display 19A, and advertising jingles or sounds which attract customers will be produced by speakers 19B. Preferably, the sounds will suggest the cooling and refreshing effects of the products offered by the vending machines or the refreshing effects of the cooling mist emitted by the misting accessory. The sounds of ice falling into a glass, a beverage being poured into a glass, a satisfied "ahhh" voiced by a refreshed customer are among the sounds which might be employed. The water and air valves and the air motor valve may be periodically operated to discharge a mist from either or both of the mist nozzle assemblies and effect opening of the bottle cap. As will be described, the mist discharge will be accompanied by a sound, like the familiar sound of $CO_2$ gas escaping from a beverage container being opened, which may serve as an enticement to potential customers.

To make a purchase at one of the vending machines, the customer will introduce the necessary amount of currency into slot 14A and will select a product by actuating one of the buttons 14B. The vend control unit 30 then issues a signal which activates the vend motors 32 and also issues a signal to controller 36 via the interface device control unit 34. In response to the signal from the vending machine, the controller 36 issues signals via the control lines to open the valves in the water and air conduits for predetermined intervals for producing a cooling mist which discharges from a mist nozzle assembly toward the customer located in front of the vending machine. Concurrently, the controller 36 sends a signal to valve 42V which operates the air motor 40 to pivot the bottle cap toward an open position. Also, signals may be issued by the controller to change the sounds produced by the speakers 19B and the appearance of display 19A, so that potential customers nearby will be alerted to the cooling and refreshing experience of the customer who has made a purchase. The sounds may simulate the familiar sound of a beverage container being opened.

If the customer is making a purchase from vending machine 10', the controller will issue signals for operating the valves in the water and air conduits supplying mist nozzle assembly 60'. The signals for operating the valves issue in a sequence which reliably produces a cloud-like mist directed toward the customer using vending machine 10'. First, the valves 68V and 70V in conduits 68 and 70 are operated to allow flow of pressurized air to the mist and air nozzles 62', 64'. Then, valve 66V' in conduit 66 is operated for a suitable interval to allow a flow of water to the mist nozzle. Valves 68V' and 70V' allow continued air flow through the mist and air nozzles for a suitable interval after the water flow stops.

The initial air flow to the mist and air nozzles creates a sound which may be like that of $CO_2$ gas escaping from a beverage container being opened. The air flow through the mist nozzle also removes any residual water which might drip from the mist nozzle. Within the mist nozzle, the incoming water breaks up into small water droplets, mixes with the pressurized air to form even smaller droplets and discharges as a very fine mist. The air current issuing from the air nozzle entrains the mist and carries the mist toward the customer. The air flow which continues after the cessation of water flow eliminates water from the mist nozzle and ensures that all of the mist is conveyed toward the customer.

Figure 3:
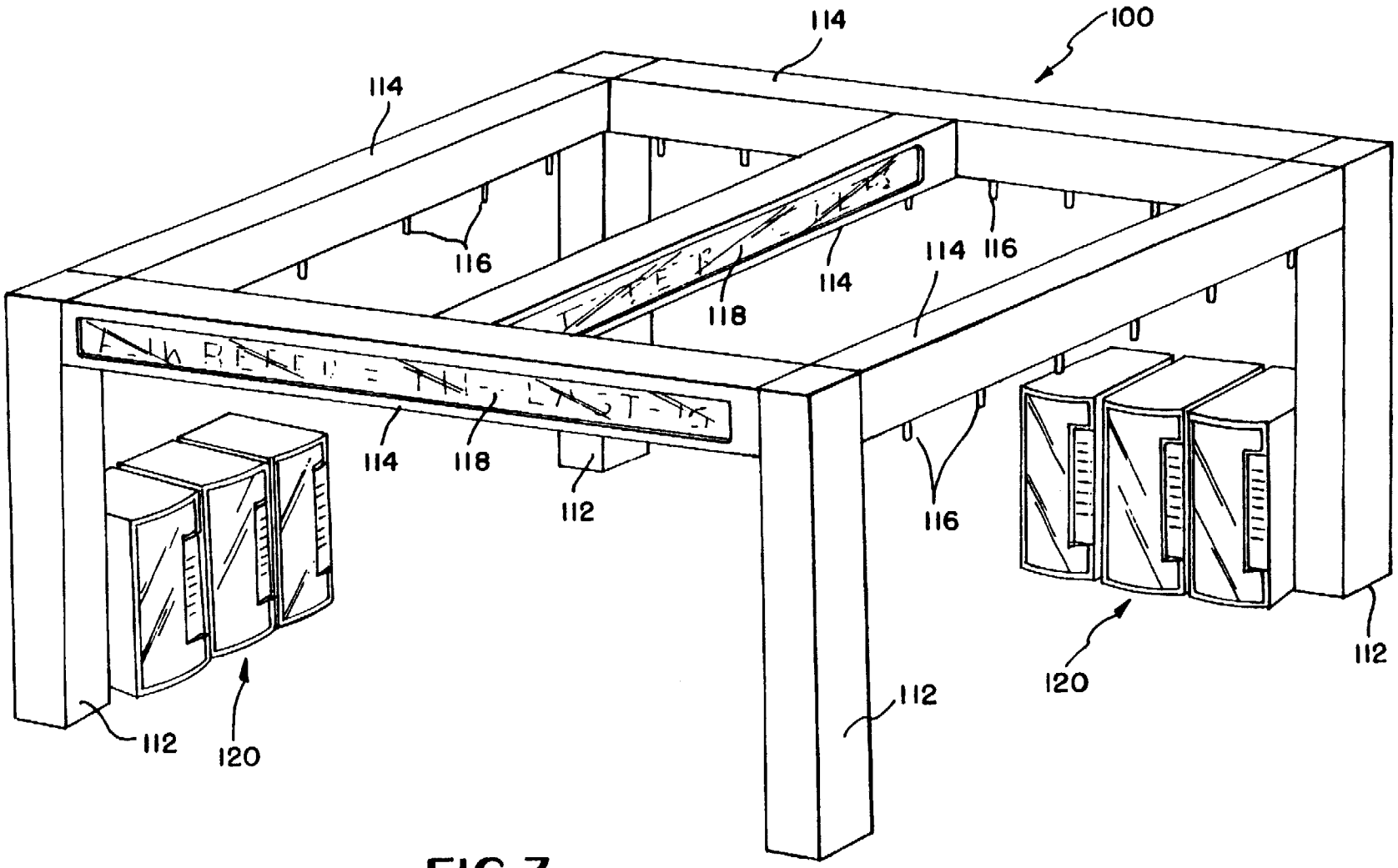
FIG. 3 illustrates a pavilion employing an array of nozzle assemblies which discharge an evaporative cooling mist.

The present invention may also be employed in a larger installation such as a pavilion. As illustrated in FIG. 3, the pavilion 100, which is large enough to accommodate a gathering of people, may be simply formed of upright columns 112 spanned by an open-work roof of elevated members 114. The columns and/or the elevated members provide support for an array of mist nozzle assemblies 116 like those employed in the vending machine installation of FIGS. 1 and 2. The columns and elevated members may also carry graphics and display panels 118. Water and air conduits and control lines (not shown) for the mist nozzle assemblies and the display panels may be supported within or on the columns and elevated members. The water and air supplies and the controller may be suitably housed within the pavilion or at a remote location. As illustrated, the pavilion accommodates vending machines 120.

According to one operating scheme, the mist nozzle assemblies will periodically discharge to provide cooling refreshment to persons gathered in the pavilion. The graphics and the display panels can serve as constant reminders of the provider of the refreshing experience.

According to another operating scheme, the mist nozzle assemblies adjacent to the vending machines may discharge a cooling mist toward a customer making a purchase at one of the machines, as described above in connection with the vending machine installation of FIGS. 1 and 2. According to still another operating scheme, all of the mist nozzle assemblies will discharge a cooling mist when a purchase is made at one of the vending machines, to thus provide a strong inducement for purchasing products from the machines.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A vending machine installation comprising:

at least one vending machine incorporating vend control means for receiving input signals from a customer requesting the dispensing of a selected item and producing vend signals in response thereto; and a misting accessory for delivering a cooling mist to the customer in response to the vend signals.

2. The vending machine installation as recited in claim 1, wherein the misting accessory comprises:

a pressurized water supply;

a pressurized air supply; and a nozzle assembly for concurrently discharging a water/air mist and an air delivery current toward the customer.

3. The vending machine installation as recited in claim 1, wherein the misting accessory further comprises:

a display panel;

a sound generator; and control means responsive to the vend signals for (1) changing the appearance of the display panel, (2) changing the sounds produced by the sound generator and (3) operating the nozzle assembly to discharge the cooling mist.

4. The vending machine installation as recited in claim 1, wherein the misting accessory further comprises:

a supply of an aromatic agent coupled to the nozzle assembly for adding an aroma to the air delivery current.

5. The vending machine installation as recited in claim 2, wherein the misting accessory further comprises:

a mist nozzle having a water inlet, an air inlet and a water/air mist outlet;

an air nozzle having an air inlet and an air outlet;

a water conduit providing a fluid flow path between the water supply and the water inlet of the mist nozzle;

first valve means in the water conduit for controlling fluid flow through the water conduit;

a first air conduit providing a fluid flow path between the air supply and the air inlet of the mist nozzle;

second valve means in the first air conduit for controlling fluid flow through the first air conduit;

a second air conduit providing a fluid flow path between the air supply and the air inlet of the air nozzle;

third valve means in the second air conduit for controlling fluid flow through the second air conduit; and control means responsive to the vend signals for operating the first, second and third valve means to allow fluid flow through the conduits.

6. The vending machine installation as recited in claim 5, wherein the control means issues signals for operating the third valve means before operating the first and second valve means.

7. The vending machine installation as recited in claim 2, wherein the at least one vending machine dispenses beverages, and the misting accessory further comprises a housing including a portion thereof which is shaped and decorated to simulate a beverage bottle neck, and the nozzle assembly is carried by the bottle neck.

8. The vending machine installation as recited in claim 7, wherein a portion of the housing is shaped and decorated to simulate a bed of ice chunks, and the simulated bottle neck appears to extend out of the bed of ice chunks.

9. The vending machine installation as recited in claim 7, wherein a simulated bottle cap is pivotally mounted to the bottle neck, the cap pivoting away from the bottle neck in response to the vend signals to simulate the appearance of an opening bottle as a mist discharges from the nozzle assembly.

10. The vending machine installation as recited in claim 2, wherein two vending machines are disposed side-by-side beneath the misting accessory, and the nozzle assembly includes nozzles for discharging a mist toward a customer operating either of the vending machines.

11. The vending machine installation as recited in claim 1, wherein the misting accessory is disposed adjacent to the at least one vending machine.

12. The vending machine installation as recited in claim 1, wherein the misting accessory is disposed above the at least one vending machine.

13. A pavilion accommodating a gathering of persons and providing evaporative cooling for persons so accommodated, the pavilion comprising:

at least one vending machine disposed within the pavilion, the at least one vending machine incorporating vend control means for receiving input signals from a customer requesting the dispensing of a selected item and producing vend signals in response thereto;

an array of nozzle assemblies for discharging a cooling mist; and control means responsive to the vend signals for operating at least one nozzle assembly to discharge a cooling mist.

14. The pavilion as recited in claim 13, wherein:

the at least one nozzle assembly is located adjacent to the at least one vending machine so as to provide evaporative cooling to a person operating the vending machine; and the control means issues signals for operating only the at least one nozzle assembly in response to the vend signals.

15. The pavilion as recited in claim 13, wherein the control means issues signals for operating all of the nozzle assemblies in response to the vend signals, so as to provide evaporative cooling to all of the persons accommodated within the pavilion.

16. The pavilion as recited in claim 13, wherein the nozzle assemblies are elevated.

17. A pavilion accommodating a gathering of persons and providing evaporative cooling for persons so accommodated, the pavilion comprising:

an array of nozzle assemblies for discharging a cooling mist, each of the nozzle assemblies incorporating (1) a mist nozzle coupled to a pressurized water supply and a pressurized air supply for discharging a water/air mist and (2) an air nozzle for discharging an air delivery current which entrains the water/air mist discharging from the mist nozzle.

18. The pavilion as recited in claim 17, wherein the nozzle assemblies are elevated.

19. The pavilion as recited in claim 17, and further comprising:

at least one vending machine disposed within the pavilion, the at least one vending machine incorporating vend control means for receiving input signals from a customer requesting the dispensing of a selected item and producing vend signals in response thereto; and control means responsive to the vend signals for operating at least one nozzle assembly to discharge a cooling mist.

* * * * *